US007097077B2

(12) United States Patent
Masuda

(10) Patent No.: US 7,097,077 B2
(45) Date of Patent: Aug. 29, 2006

(54) FLUID-DISPENSING PUMP AND CONTAINER PROVIDED THEREWITH

(76) Inventor: Masatoshi Masuda, 2, 9-banchi, Takada-Cho, Saiin, Ukyo-ku, Kyoto-city, Kyoto 615-0031 (JP)

( * ) Notice: Subject to any disclaimer, the term of this patent is extended or adjusted under 35 U.S.C. 154(b) by 82 days.

(21) Appl. No.: 11/048,315

(22) Filed: Feb. 1, 2005

(65) Prior Publication Data

US 2005/0173460 A1 Aug. 11, 2005

(30) Foreign Application Priority Data

Feb. 5, 2004 (JP) ..... 2004-028770

(51) Int. Cl.
*B65D 37/00* (2006.01)

(52) U.S. Cl. ..... 222/321.7; 222/321.9; 222/387

(58) Field of Classification Search ... 222/321.7–321.9
See application file for complete search history.

(56) References Cited

U.S. PATENT DOCUMENTS

2004/0055457 A1 3/2004 Masuda

FOREIGN PATENT DOCUMENTS

JP 2002-066401 3/2002
JP 2004-051201 2/2004

*Primary Examiner*—J. Casimer Jacyna
(74) *Attorney, Agent, or Firm*—Knobbe, Martens, Olson & Bear LLP

(57) ABSTRACT

A fluid-storing container includes a fluid-dispensing pump 1 having an inflow valve mechanism 4, an outflow valve mechanism 5, a bellows member 6 and a leakage prevention member 101, a nozzle head 2, and a fluid-storing portion 3. The leakage prevention member 101 is disposed at the lower end of a coupling member 102 and allows a fluid to pass through only when the bellows member 6 deforms.

20 Claims, 16 Drawing Sheets

FLUID-DISPENSING PUMP AND CONTAINER PROVIDED THEREWITH

BACKGROUND OF THE INVENTION

1. Field of the Invention

The present invention generally relates to a fluid-dispensing pump for discharging a fluid stored inside a fluid-storing portion from a nozzle head disposed on the upper side of the fluid-storing portion by pressing the nozzle head.

2. Description of the Related Art

As this type of fluid-dispensing pump, for example, as described in Japanese Patent Laid-open No. 2002-066401, a fluid-dispensing pump comprising a nozzle head for discharging a fluid, a fluid-storing portion for storing the liquid, a cylinder disposed on the upper side of the fluid-storing portion, a piston which can reciprocate inside the cylinder with the nozzle head being pressed, an inflow valve mechanism for letting the fluid stored in the fluid-storing portion flow into the cylinder with an ascending motion of the piston, and an outflow valve mechanism for letting the fluid flow out to the nozzle head with an descending motion of the piston has been used.

However, because this conventional type of fluid-dispensing pumps requires high-precision work for an outer peripheral surface of the piston and for an inner peripheral surface of the cylinder so as to allow the piston to reciprocate smoothly inside the cylinder, it has a problem that fluid-dispensing pump costs become expensive.

For this reason, as described in the specification of a patent application (Japanese Patent Laid-open No. 2004-51201 or U.S. Publication No. 2004/0055457) filed by the applicant of the present invention, a fluid-dispensing pump is proposed which comprises, for example, a resinous bellows member capable of deforming from a stretched position in which it holds a relatively large amount of fluid therein to a folded-up position in which it holds a relatively small amount of fluid therein, an inflow valve mechanism coupled with the inflow opening of the bellows member, and an outflow valve mechanism coupled with the outflow opening of the bellows member. According to the fluid-dispensing pump described above, manufacturers' costs can be cut down as compared with fluid-dispensing pumps using pistons, etc.

The fluid-dispensing pump described in Japanese Patent Laid-open No. 2004-51201 or U.S. Publication No. 2004/0055457 is designed in an embodiment so that a fluid stored inside a fluid-storing portion flows into the bellows member after having passed through the inflow valve mechanism by a pressure difference occurring between inside the bellows member and outside the bellows member against the inflow valve mechanism when the bellows member deforms from a folded-up position to a stretched position. Therefore, if large load is applied to the fluid-storing portion, or if the top and bottom of the fluid-storing portion and the fluid-dispensing pump are reversed, the fluid flows into the bellows member; if inflow of the fluid into the bellows member advances, a pressure inside the bellows member against the outflow valve mechanism becomes larger than a pressure outside the bellows member by the fluid having flowed in. As a result, a problem that the fluid leaks out from the outflow valve mechanism to outside the fluid-dispensing pump occurs.

In the above, Japanese Patent Laid-open No. 2004-51201 and U.S. Publication No. 2004/0055457 describe the present inventor's own work which were published less than one year before this application, and the above descriptions apply to some embodiments disclosed therein and are in no way intended to affect their claim construction.

SUMMARY OF THE INVENTION

In an aspect, an object of the present invention is to solve one or more of the above-mentioned problems. An object of an embodiment of the present invention is to provide a fluid-dispensing pump having a simple configuration and capable of preventing fluid leakage.

The present invention can be practiced in various ways including, but not limited to, embodiments described below, wherein numerals used in the drawings are used solely for the purpose of ease in understanding of the embodiments which should not be limited to the numerals. Further, different terms or names may be assigned designated to the same element, and in that case, one of the different terms or names may functionally or structurally overlap or include the other or be used interchangeably with the other.

In an embodiment, the present invention provides a fluid-dispensing pump (e.g., 1, 100) for discharging therethrough a fluid stored inside a fluid-storing portion (e.g., 3, 300) from a nozzle head (e.g., 2), said fluid-dispensing pump being configured to be disposed between the fluid-storing portion and the nozzle head and comprising: (i) a compressible hollow structure (e.g., 6) having an inflow opening (e.g., 620) and an outflow opening (e.g., 610), through which the fluid passes, said compressible hollow structure being compressible between an extended position and a compressed position; (ii) an inflow valve mechanism (e.g., 4, 400) connected to the inflow opening of the compressible hollow structure, said inflow valve mechanism being a one-way valve which opens when the compressible hollow structure is extended from the compressed position to the extended position; (iii) an outflow valve mechanism (e.g., 5) connected to the outflow opening of the compressible hollow structure, said outflow valve mechanism being a one-way valve which opens when the compressible hollow structure is compressed from the extended position to the compressed position; and (iv) a leakage prevention valve mechanism (e.g., 7) being disposed within the compressible hollow structure and between the inflow valve mechanism and the outflow valve mechanism, said leakage prevention valve mechanism comprising a valve which is movable with the compressible hollow structure, which is closed when the compressible hollow structure is at the extended position, and which is open when the compressible hollow structure is between the extended position and the compressed position.

In the above, typically, the leakage prevention valve mechanism is open, when either the inflow valve mechanism or the outflow valve mechanism is open, whereas the leakage prevention valve mechanism is closed when both the inflow valve mechanism and the outflow valve mechanism is closed. The leakage prevention valve mechanism can effectively prevent leakage of the fluid from the nozzle head or elsewhere. In the present invention, the term "connected" may mean physically or functionally directly or indirectly connected.

The above embodiment further includes, but is not limited to, the following embodiments:

The compressible hollow structure may be constituted by a bellows member (e.g., 601). The bellows member may be capable of restoring to the extended position from compressed position by its own elastic force.

A valve member (e.g., 520) of the outflow valve mechanism and a valve member (e.g., 101) of the leakage prevention valve mechanism may be connected by a coupling member to move together relative to the inflow valve mechanism as the compressible hollow structure is compressed or extended. The coupling member may comprise multiple ribs (e.g., 103) each extending outward from an axis of the coupling member, wherein the fluid passes through spaces between the multiple ribs.

The pump may further comprise a guiding member (e.g., 413) disposed between the inflow valve mechanism and the outflow valve mechanism for guiding movement of the coupling member. The guiding member may be connected integrally to the inflow valve mechanism. The guiding member may be cylindrical. The coupling member may comprise multiple ribs (e.g., 103) each extending outward from an axis of the coupling member, wherein the fluid passes through spaces between the multiple ribs, and outer edges of the ribs slide upon an inner surface of the guiding member.

The leakage prevention valve mechanism may further comprise a valve guiding member (e.g., 427) connected to the inflow valve mechanism, wherein a peripheral edge (e.g., 111) of the valve (e.g., 101) of the leakage prevention valve mechanism slides upon an inner surface of the valve guiding member. The inner surface of the valve guiding member may be comprised of a full surface portion (e.g., 427') and a notched surface portion (e.g., 428'), wherein the valve of the leakage prevention mechanism is closed when the peripheral edge of the valve of the leakage prevention valve mechanism is on the full surface portion, and the valve of the leakage prevention mechanism is open when the peripheral edge of the valve of the leakage prevention valve mechanism is on the noticed surface portion.

The inflow valve mechanism may comprise a valve seat member (e.g., 410) in which an opening portion (e.g., 412) for fluid inflow is formed, and a valve member (e.g., 420) comprising an annular supporting portion (e.g., 421), a valve portion (e.g., 422) having a shape corresponding to the opening portion of the valve seat member, and multiple flexible coupling portions (e.g., 423, 424) for coupling the supporting portion and the valve portion, wherein the annular supporting portion serves as the valve guiding member (e.g., 427) for the leakage prevention valve mechanism. The valve seat member of the inflow valve mechanism may have a nearly or substantially cylindrical shape at the bottom of which a circular opening portion (e.g., 412) is formed, and the valve member is disposed inside the valve seat member.

The inflow valve mechanism may comprise a valve seat member (e.g., 410) in which an opening portion (e.g., 412) for fluid inflow is formed, and a valve member (e.g., 420) comprising an annular supporting portion (e.g., 421), a valve portion (e.g., 422) having a shape corresponding to the opening portion of the valve seat member, and multiple flexible coupling portions (e.g., 423, 424) for coupling the supporting portion and the valve portion, wherein the guiding member (e.g., 413) for the coupling member (e.g., 102) is integrated with the valve seat member.

The valve seat member may have a flange (e.g., 416, 436) configured to be attached to a neck portion (e.g., 10, 110) of the fluid-storing portion. The flange may be provided with an air inflow mechanism (e.g., 440) for introducing air into the fluid-storing portion as an inner pressure of the fluid-storing portion (e.g., 300) decreases.

The outflow valve mechanism may comprise a tubular valve seat member (e.g., 510) and a flexible valve member (e.g., 520) having a shape corresponding to an inner surface (e.g., 511) of the valve seat member.

In all of the aforesaid embodiments, any element used in an embodiment can interchangeably be used in another embodiment unless such a replacement is not feasible or causes adverse effect. Further, the present invention can equally be applied to apparatuses and methods.

In another aspect, the present invention provides a container for storing and discharging a fluid, comprising: (a) a fluid-storing portion (e.g., 3, 300) for storing a fluid therein; (b) a nozzle head (e.g., 2) for discharging the fluid therethrough; and (c) any one of the fluid-dispensing pumps (e.g., 1) set forth above provided between the fluid-storing portion and the nozzle head.

The above embodiment further includes, but is not limited to, the following embodiments:

The fluid-storing portion may be comprised of a neck portion (e.g., 10) to which the fluid-dispensing pump is connected, a side wall (e.g., 15), and a piston (e.g., 16) provided at a bottom opposite to the neck portion, said piston being movable toward the neck portion as an inner pressure of the fluid-storing portion decreases. The fluid-storing portion may be comprised of a neck portion (e.g., 110) to which the fluid-dispensing pump is connected, a side wall (e.g., 20), and a bottom, wherein the inflow valve mechanism has a flange (e.g., 436) attached to the neck portion, said flange provided with an air inflow mechanism (e.g., 440) for introducing air into the fluid-storing portion as an inner pressure of the fluid-storing portion decreases.

For purposes of summarizing the invention and the advantages achieved over the related art, certain objects and advantages of the invention have been described above. Of course, it is to be understood that not necessarily all such objects or advantages may be achieved in accordance with any particular embodiment of the invention. Thus, for example, those skilled in the art will recognize that the invention may be embodied or carried out in a manner that achieves or optimizes one advantage or group of advantages as taught herein without necessarily achieving other objects or advantages as may be taught or suggested herein.

Further aspects, features and advantages of this invention will become apparent from the detailed description of the preferred embodiments which follow.

BRIEF DESCRIPTION OF THE DRAWINGS

These and other features of this invention will now be described with reference to the drawings of preferred embodiments which are intended to illustrate and not to limit the invention. The drawings are oversimplified for illustrative purposes.

FIG. 5(*a*) is a top view, FIG. 5(*b*) is a sectional view, and FIG. 5(*c*) is a side view.

FIG. 6(*a*) is a top view, and FIG. 6(*b*) is a sectional view.

FIG. 7(*a*) is a side view, FIG. 7(*b*) is a sectional view, and FIG. 7(*c*) is a bottom view.

FIG. 10(*a*) is a top view, FIG. 10(*b*) is a sectional view, and FIG. 10(*c*) is a bottom view.

FIG. 15(*a*) is a top view, and FIG. 15(*b*) is a sectional view.

FIG. 16(*a*) is a top view, FIG. 16(*b*) is a sectional view, and FIG. 16(*c*) is a bottom view.

Figure 1:
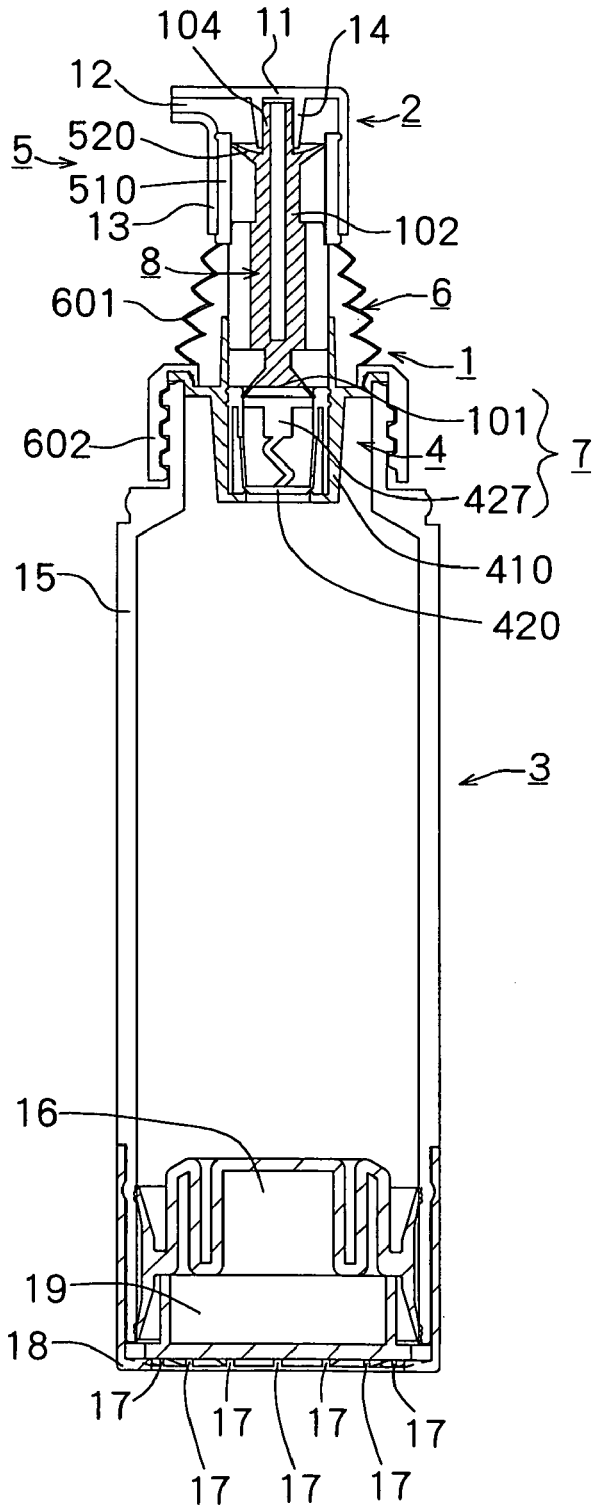
FIG. 1 is a longitudinal sectional view of a fluid-storing container wherein the fluid-dispensing pump 1 according to Embodiment 1 of the present invention is applied.

Explanation of symbols used in the drawings are as follows: 1: Fluid-dispensing pump; 2: Nozzle head; 3: Fluid-storing portion; 4: Inflow valve mechanism; 5: Outflow valve mechanism; 6: Bellows member; 7: Leakage prevention mechanism; 8: Fluid-flowing aid; 10: Neck portion; 11: Pushing portion; 12: Fluid discharge portion; 13: First joined portion; 14: Second joined portion; 15: Cylinder; 16: Piston; 17: Air vent; 18: Bottom cover; 19: Supporting member; 20: Fluid-storing tank; 21: Inflow pipe; 100: Fluid-dispensing pump; 101: Leakage prevention member; 102: Coupling member; 103: Rib; 104: Engaging portion; 105: Hollow portion; 300: Fluid-storing portion; 400: Inflow valve mechanism; 410: Valve seat member; 411: Valve seat portion; 412: Opening portion; 413: Guiding portion; 414: First engaging portion; 415: Second engaging portion; 416: Third engaging portion; 420: Valve member; 421: Supporting portion; 422: Valve portion; 423: Coupling portion; 424: Flexion; 425: Reinforcing portion; 426: Engaging portion; 427: Guiding portion; 428: Notched portion; 430: Valve seat member; 431: Valve seat portion; 432: Opening portion; 433: Guiding portion; 434: First engaging portion; 435: Second engaging portion; 436: Third engaging portion; 440: Air inflow mechanism; 441: Hole portion; 442: Supporting portion; 443: Groove portion; 450: Second valve member; 451: Valve portion; 452: Joined portion; 453: Coupling portion; 501: Valve seat member; 502: Valve member; 510: Valve seat member; 511: Inner wall; 520: Valve member; 601: Bellows portion; 602: Joined portion; 610: Outflow opening; 620: Inflow opening.

DETAILED DESCRIPTION OF THE PREFERRED EMBODIMENT

The present invention will be explained with respect to preferred embodiments. However, the present invention is not limited to the preferred embodiments.

Embodiment 1 of the present invention is described in detail below with reference to drawings attached.

Figure 2:
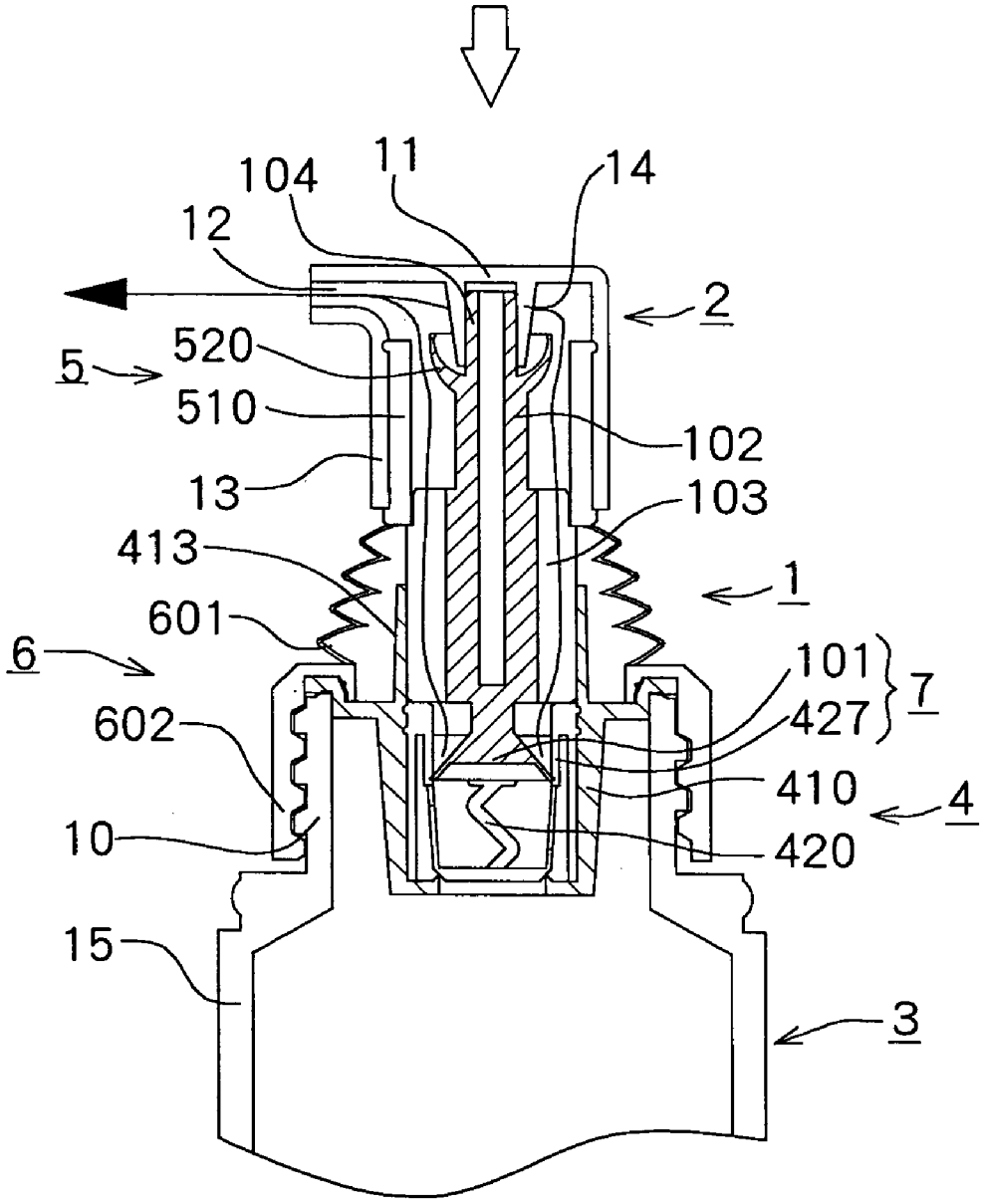
FIG. 2 is an enlarged view showing the substantial part of the fluid-storing container wherein the fluid-dispensing pump 1 according to Embodiment 1 of the present invention is applied.
Figure 3:
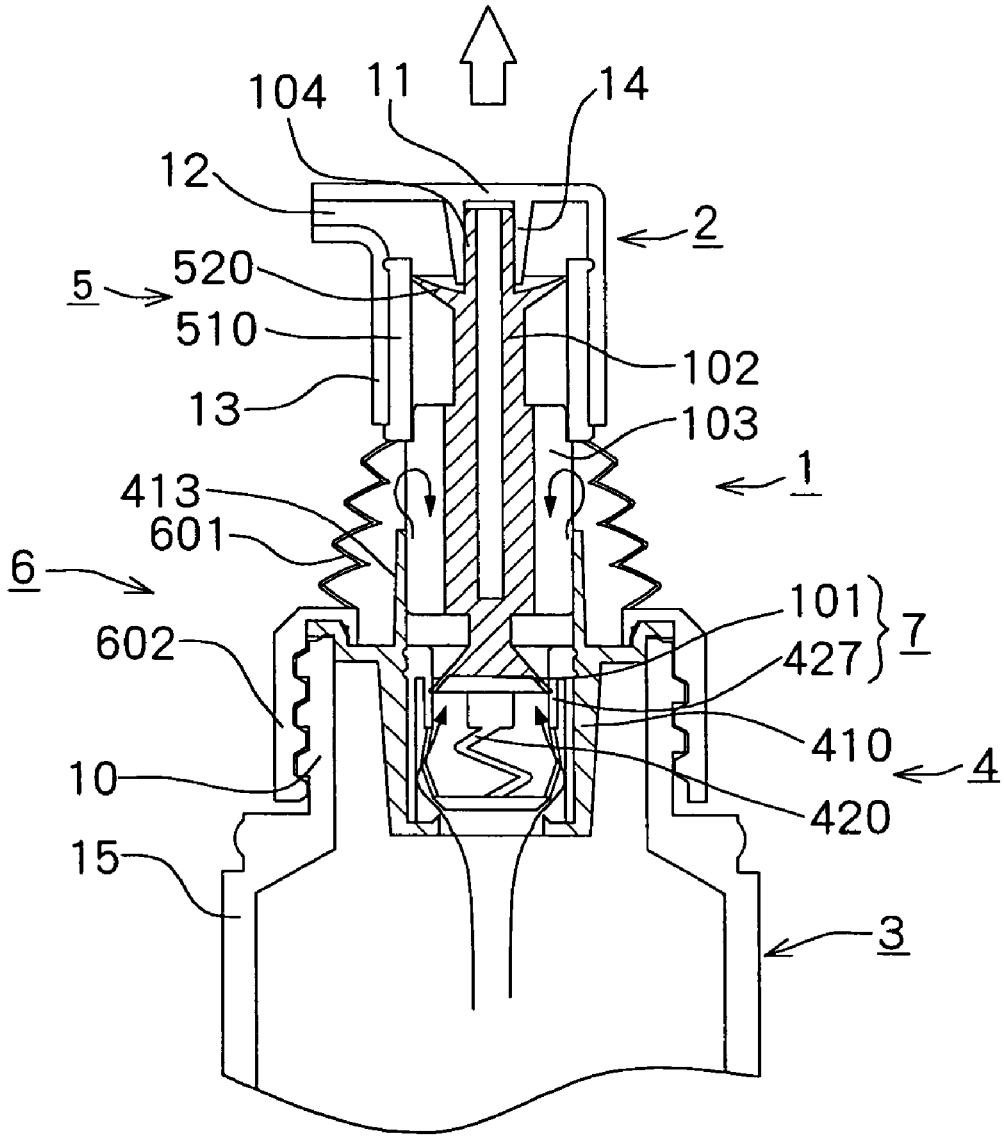
FIG. 3 is an enlarged view showing the substantial part of the fluid-storing container wherein the fluid-dispensing pump 1 according to Embodiment 1 of the present invention is applied.
Figure 4:
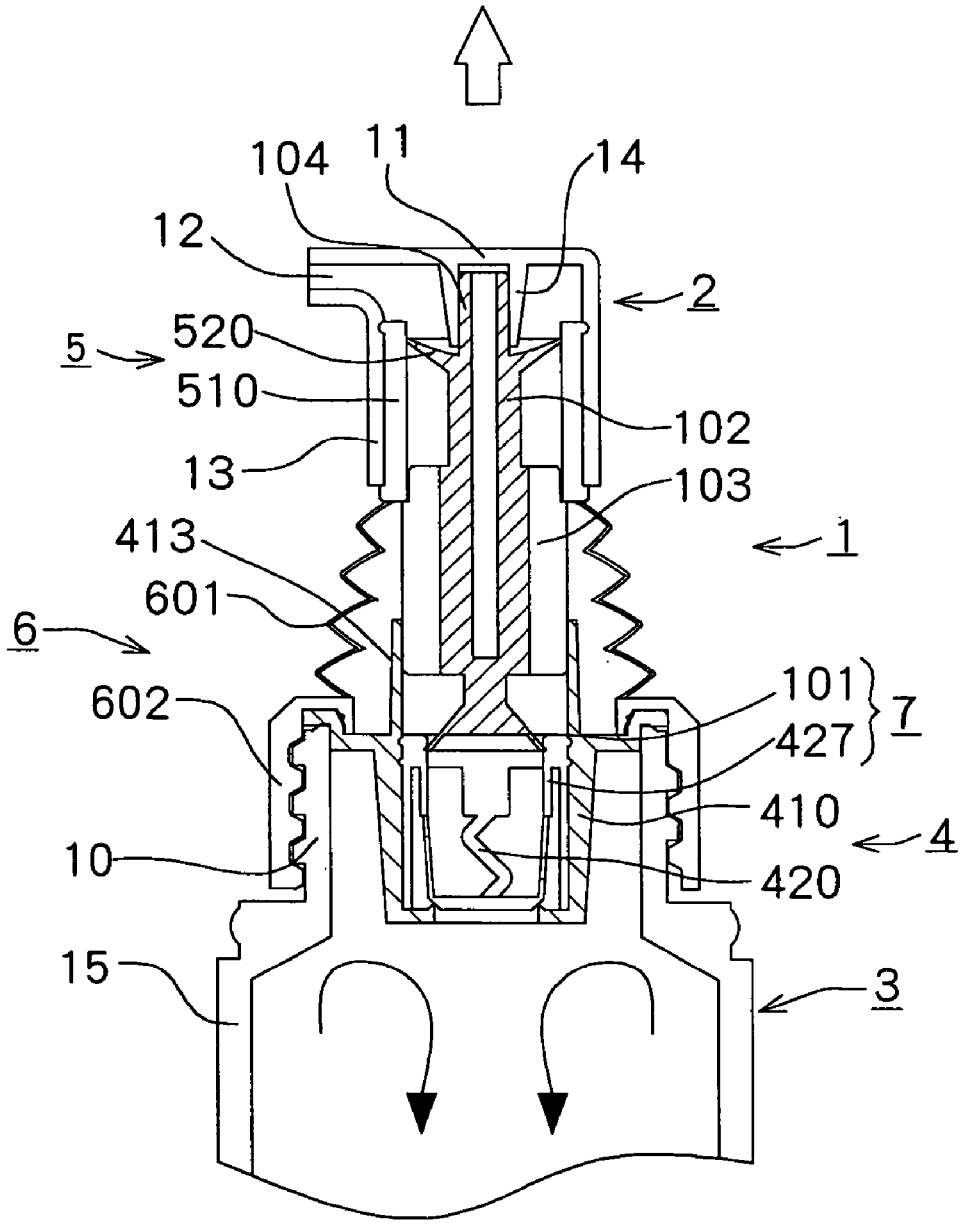
FIG. 4 is an enlarged view showing the substantial part of the fluid-storing container wherein the fluid-dispensing pump 1 according to Embodiment 1 of the present invention is applied.

FIG. 1 is a longitudinal sectional view of a fluid-storing container to which the fluid-dispensing pump 1 according to Embodiment 1 of the present invention applies. FIGS. 2–4 are enlarged views of the substantial part of FIG. 1.

Of these figures, FIG. 1 shows the fluid-dispensing pump 1 being left with no stress applied to it; FIG. 2 shows the bellows member 6 being deforming from a stretched position to a folded-up position with a pushing portion 11 in the nozzle head 2 being pressed; FIG. 3 shows the bellows member 6 being deforming from a folded-up position to a stretched position a position with a pressure applied to the pushing portion 11 in the nozzle head 2 being removed; FIG. 4 shows the bellows member 6 having returned to its initial stretched-position.

This fluid-storing container is used as a container for beauty products for storing gels such as hair gels and cleansing gels, creams such as nourishing creams and cold creams or liquids such as skin lotions used in the cosmetic field. Additionally, this fluid-storing container also can be used as a container for medicines, solvents or foods, etc.

In this specification, high-viscosity liquids, semifluids, gels that sol solidifies to a jelly, and creams and regular liquids are all referred to as fluids. However, the present invention is not limited to the above-mentioned pump intended to be used with liquids, but can be applied to fluid-dispensing pumps intended to be used with fluids including gases.

This fluid-storing container comprises a fluid-dispensing pump 1 having an inflow valve mechanism 4, an outflow valve mechanism 5, a bellows member 6 and a leakage prevention member 101, a nozzle head 2 having a pushing portion 11 and a fluid discharge portion 12, and a fluid-storing portion 3 having a cylinder 15 and a piston 16 for storing a fluid.

The nozzle head 2 here comprises the pushing portion 11, the discharge portion 12 for discharging a fluid, a first joined portion 13 to be joined with the bellows member 6 and a second joined portion 14 to be joined with the outflow valve mechanism 5.

Additionally, the fluid-storing portion 3 has a tubular cylinder 15, a piston 16 traveling upward and downward inside the cylinder 15, a bottom cover 18 in which multiple air vents 17 are formed, a supporting member 19 for supporting the piston 16 when the piston 16 internally contacts the bottom cover 18 and is positioned at the lower limit inside the cylinder 15.

In this fluid-storing container, by pressing the pushing portion 11 in the nozzle head 2 so as to reciprocate the nozzle head upward and downward, a fluid stored inside the fluid-storing portion 3 is discharged from the discharge portion 12 in the nozzle head 2 by the action of the fluid-dispensing pump 1. With a fluid amount stored inside the fluid-storing portion 3 being decreasing, the piston 16 travels upward toward the nozzle head 2 inside the cylinder 15.

Additionally, in this specification, upward and downward directions in FIGS. 1 to 4 are defined as upward and downward directions in the fluid-storing container. In other words, in the fluid-storing container according to Embodiment 1 of the present invention, the side of the nozzle head 2 shown in FIG. 1 is defined as the upward direction; the side of the piston 16 is defined as the downward direction.

Figure 5:
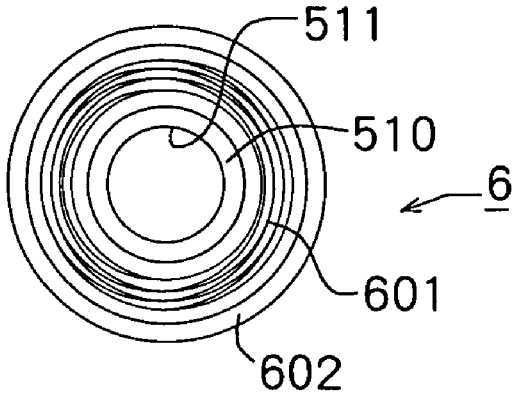
FIGS. 5(*a*), 5(*b*), and 5(*c*) are explanatory views showing the bellows member 6 in the fluid-dispensing pump 1.
Figure 5:
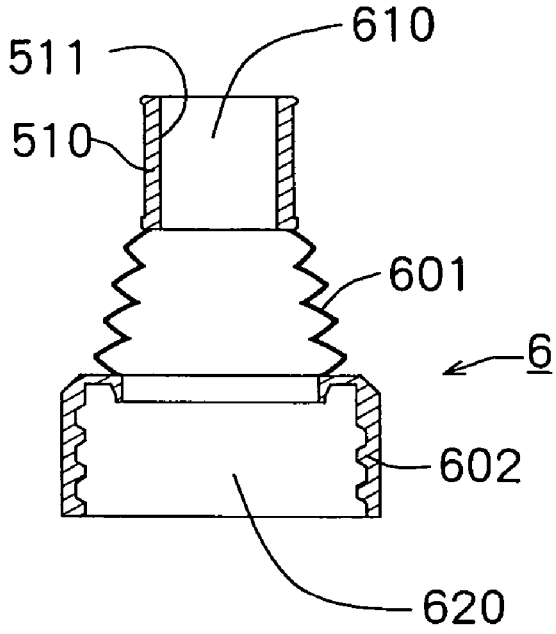
Figure 5:
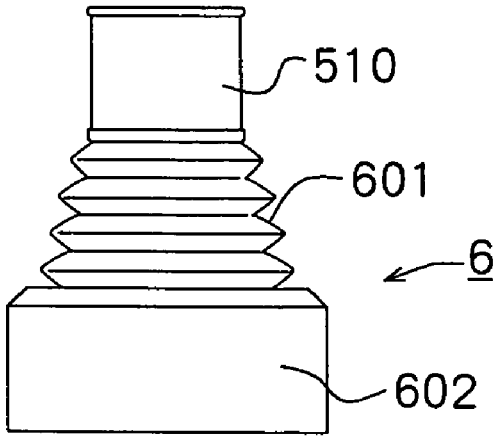

A configuration of the fluid-dispensing pump 1 is described in detail below. FIGS. 5(*a*), 5(*b*), and 5(*c*) are explanatory views showing the bellows member 6 in the fluid-dispensing pump 1.

The bellows member 6 has a bellows portion 601 made by molding a resin having given elastic force into a shape of a bellows and a joined portion 602 formed at a lower end of the bellows portion 601 for joining the inflow valve mechanism 4 and the cylinder 15. A valve seat member 510 in the outflow valve mechanism 5 described in detail later is joined with an upper end of the bellows portion 601. Additionally, the bellows member 601 and the valve seat member 510 in the outflow valve mechanism 5 can be integrated and formed as a one piece. Integrating these members enables to reduce assembly load and to cut manufacturers' costs down.

The bellows portion 601 is formed, for example, by blow molding or injection molding. The bellows member 6 is capable of deforming between a stretched position which it holds a relatively large amount of fluid therein as shown in FIGS. 1 and 4 and a folded-up position in which it holds a relatively small amount of fluid therein as shown in FIGS. 2 and 3.

Figure 6:
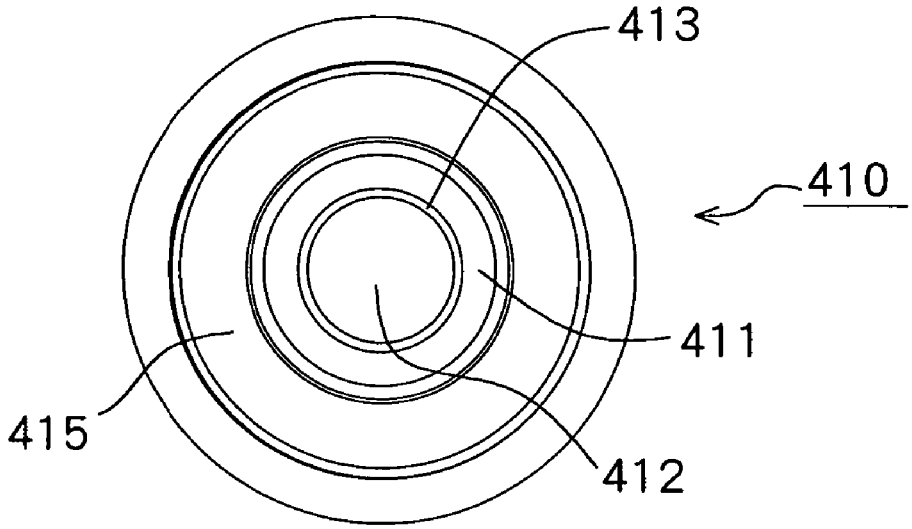
FIGS. 6(*a*) and 6(*b*) are explanatory views showing the valve seat member 410 comprising the inflow valve mechanism 4 in the fluid-dispensing pump 1.
Figure 6:
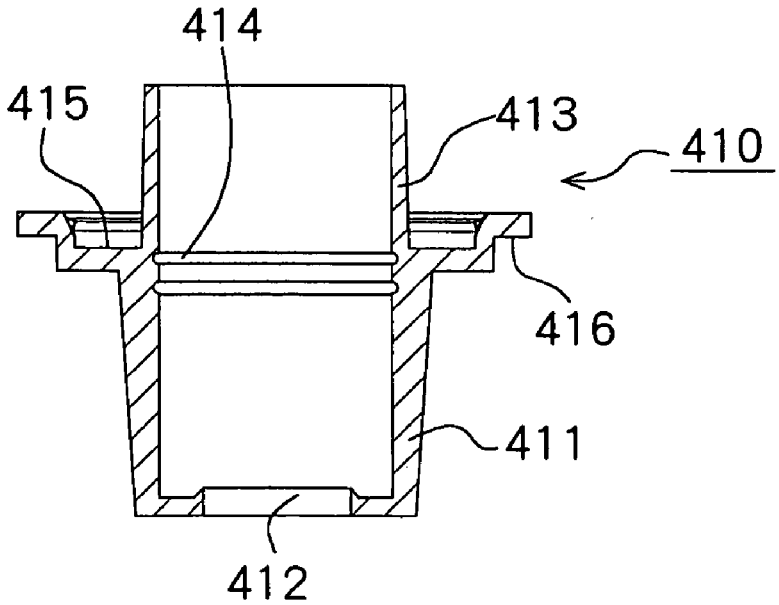
Figure 7:
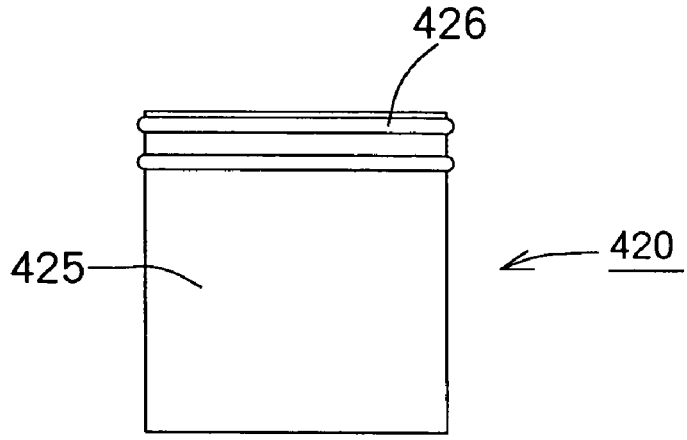
FIGS. 7(*a*), 7(*b*), and (*c*) are explanatory views showing the valve member 420 comprising the inflow valve mechanism 4 in the fluid-dispensing pump 1.
Figure 7:
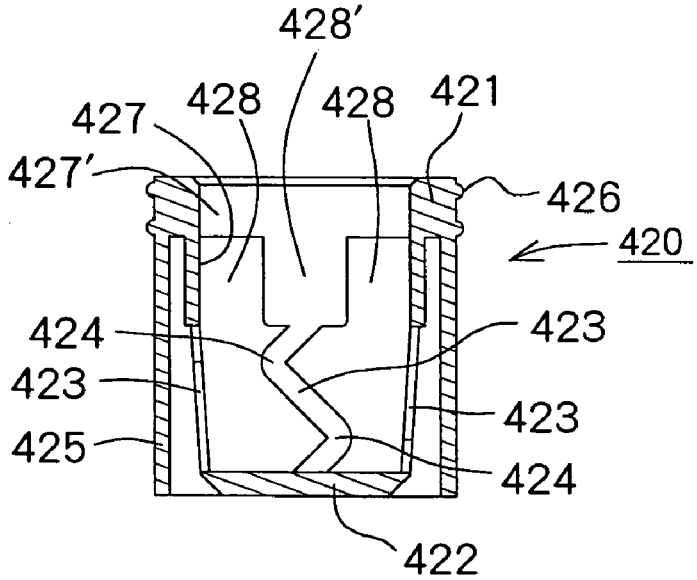
Figure 7:
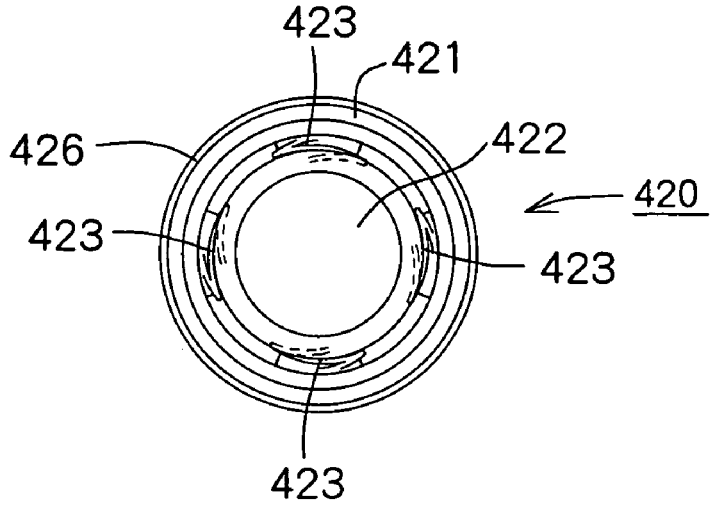

A configuration of the inflow valve mechanism 4 is described in detail below. FIGS. 6(*a*) and 6(*b*) are explanatory views showing the valve seat member 410 comprising the inflow valve mechanism 4 in the fluid-dispensing pump 1. FIGS. 7(*a*)–(*c*) are explanatory views showing the valve member 420 comprising the inflow valve mechanism 4 in the fluid-dispensing pump 1. FIGS. 6(*a*) and 6(*b*) are a plan view and lateral cross section, respectively, showing the valve seat member 410. FIGS. 7(*a*)–(*c*) are a lateral view, lateral cross section, and bottom view, respectively, showing the valve member 420.

The inflow valve mechanism 4 is intended for use in allowing a fluid to pass through from the fluid-storing portion 3 into the bellows member 6 as well as preventing backward flow of the fluid from the bellows member 6 to the fluid-storing portion 3.

As shown in FIGS. 6(*a*) and 6(*b*), the valve seat member 410 has a nearly cylindrical valve seat portion 411 at the bottom of which a circular opening portion 412 is formed and a tubular guiding portion 413 for guiding traveling of a coupling member 102 described in detail later (See FIGS. 8 to 10). Additionally, in this valve seat member 410, a first engaging portion 414 for engaging with the valve member 420, a second engaging portion 415 for engaging with the bellows member 6 and a third engaging portion for engaging with the cylinder 15 are provided.

As shown in FIGS. 7(*a*)–(*c*), the valve member 420 has an annular supporting portion 421 disposed inside the valve seat member 410, a valve portion 422 having a shape corresponding to the opening portion 412 in the valve seat member 410, four flexible coupling portions 423 for coupling the supporting portion 421 and the valve portion 422, and a reinforcing portion 425 for reinforcing the supporting portion 421. On the outer peripheral surface of the supporting portion 421, an engaging portion 426 for engaging with the first engaging portion 414 in the valve seat member 410 is provided. On the inner side of the supporting portion 421, a guiding portion 427 for guiding traveling of the leakage prevention member 101 described in detail later is provided. On the valve portion 422 side of the guiding portion 427, multiple notched portions 428 are formed. The respective four coupling portions 423 have a pair of flexions. In this valve member 420, by the flexibility of the four coupling portions 423, the valve portion 422 is adapted to be able to travel between a closed position in which the valve portion 422 closes the opening portion 412 in the valve seat member 410 and an open position in which it opens the opening portion 412.

The inflow valve mechanism 4 is constituted by the valve member 420 being inserted into and fixed with the valve seat member 410 with the first engaging portion 414 being fitting into the engaging portion 426. These valve seat member 410 and valve member 420 may be constituted by, for example, a resin such as polyethylene and polypropylene, rubber composite such as silicon rubber, or a mixture of the foregoing.

In the inflow valve mechanism 4 having this configuration, when inside the bellows member 6 is depressurized as shown in FIG. 3, the valve portion 422 in the valve member 420 separates from the opening portion 412 in the valve seat member 410 and travels to the open position in which the opening portion 412 is opened. By this, a fluid stored in the fluid-storing portion 3 passes through the opening portion 412. When inside the bellows member 6 is not depressurized, the valve portion 422 in the valve member 420 travels to the closed position in which the opening portion 412 in the valve seat member 410 is closed by the flexibility of four coupling portions 423.

In this inflow valve mechanism 4, the supporting portion 421 in the valve member 420 and the valve portion 422 are coupled by the four coupling portions 423. Therefore, it becomes possible to prevent inadequate inclination of the valve portion 422 from occurring. Additionally, in order to effectively prevent inadequate inclination of the valve portion 422 from occurring, it is preferable to provide 3 or more coupling portions 422 and it is more preferable to dispose them at equal distances.

Additionally, in this inflow valve mechanism 4, the coupling portions 423 are enclosed by the reinforcing portion 425. Therefore, when an inadequate inclination occurs in the valve portion 422 while the valve portion 422 travels from the closed position to the open position, further inclination of the valve portion 422 is prevented by the coupling portions 423 being contacting the reinforcing portion 425.

Furthermore, in this inflow valve mechanism 4, the respective four coupling portions 423 for coupling the supporting portion 421 and the valve portion 422 have a pair of flexions. Consequently, the respective coupling portions 423 have adequate elasticity, thereby making it possible for the valve portion 422 to reciprocate smoothly between the closed position and the open position. Additionally, for the coupling portion 423, a thickness of 1 mm or less is preferable; a thickness of 0.3 mm to 0.5 mm is more preferable.

With the above-mentioned configuration of the inflow valve mechanism 4, even though its configuration is simple, backward flow of the fluid can be reliably prevented and a flow rate of the fluid passing though can be changed according to a pressure difference between the fluid inflow side and the fluid outflow side in the inflow valve mechanism 4.

A configuration of the outflow valve mechanism 5 and the leakage prevention mechanism 101 is described in detail below. FIG. 8 is a perspective view showing a valve member 520 in the outflow valve mechanism 5 and a fluid-flowing aid 8 having a leakage prevention member 101. FIG. 9 show lateral views of FIG. 8; FIGS. 10(*a*), 10(*b*), and 10(*c*) show a plan view, lateral cross-section and bottom view of FIG. 8 respectively.

Being coupled by the coupling member 102, the valve member 520 of the outflow valve mechanism 5 and the leakage prevention member 101 in the fluid-dispensing pump 1 according to this embodiment of the present invention integrally constitute the fluid-flowing aid 8. This configuration enables the outflow valve mechanism 5 and the leakage prevention member 101 to travel relative to the inflow valve mechanism 4 as the bellows member 6 stretches and folds up, thereby making it possible to give a simpler configuration to the fluid-dispensing pump 1.

The fluid-flowing aid 8 comprises the coupling member 102 on the upper end of which an engaging portion 104 for engaging with the nozzle head 2 is formed, the valve member 520 being disposed on the top of the coupling member 102 and comprising the outflow valve mechanism 5, the leakage prevention member 101 being disposed at the lower end of the coupling member 102 and enabling a fluid having passed through the inflow valve mechanism 4 to pass through only when the bellows member 6 deforms from the folded-up position to the stretched position, and twelve ribs 103 disposed between the valve member 520 and the leakage prevention member 101. Additionally, inside the fluid-flowing aid 8, a hollow portion 105 is formed. This hollow portion 105 functions as a relief for preventing occurrence of a distortion when the fluid-flowing aid 8 is molded.

The leakage prevention member 101 has a shape corresponding to the guiding portion 427 of the valve member 420 in the inflow valve mechanism 4. As a material for this leakage prevention member 101, it is preferable to use a hard material; however, in order to prevent a fluid from leaking out, because the leakage prevention member 101 needs to travel being closely contacting the guiding portion 427, using a material with slight elasticity is preferable.

In this type of leakage prevention member 101, when the fluid-flowing aid 8 travels in a direction approaching the inflow valve mechanism 4 with the pushing portion 11 in the nozzle head 2 being pressed, as shown in FIG. 2, by being guided by the guiding portion 427, it travels further to an open position facing the notched portions 428 to enable the fluid having passed through the inflow valve mechanism 4 to pass through. When the fluid-flowing aid 8 travels in a direction separating from the inflow valve mechanism 4 with a pressure applied to the pushing portion 11 in the nozzle head 2 being removed, as shown in FIG. 4, it travels to a closed position not facing the notched portions 428 by being guided by the guiding portion 427.

The rib 103 has a shape corresponding to an inner wall of the tubular guiding portion 413 of the valve seat member 410 in the inflow valve mechanism 4. Adjacent ribs 103 are disposed parallel to each other so as to allow a fluid to pass through smoothly. Additionally, having multiple ribs 103, the fluid-flowing aid 8 enables to prevent inadequate inclination from occurring in the valve member 520 or the leakage prevention member 101. In order to effectively prevent inadequate inclination from occurring in the valve member 520 or the leakage prevention member 101, it is preferable to provide 3 or more ribs 103; more preferable to dispose them at even distances.

The outflow valve mechanism 5, as shown in FIGS. 2–4, comprises the tubular valve seat member 510 to be joined with the bellows member 6, which is shown in FIGS. 5(*a*), 5(*b*), and 5(*c*), and the flexible valve member 520 having a shape corresponding to an inner wall 511 of the valve seat member 410. The valve member 520 may be constituted by a resin such as polyethylene and polypropylene, rubber composite such as silicon rubber, or a mixture of the foregoing.

In this outflow valve mechanism 5, when inside the bellows member 6 is pressurized, a contacting portion 521 in the valve member 520 travels to the open position in which it separates from the inner wall 511 in the valve seat member 510. By this, a fluid stored inside the bellows member 6 passes through inside the tubular valve seat member 510. When inside the bellows member 6 is not pressurized, the contacting portion 521 in the valve member 520 travels to the closed position in which it contacts the inner wall 511 in the valve seat member 510 by the flexibility of the valve member 520.

In the fluid-storing container having the above-mentioned configuration, when the pushing portion 11 in the nozzle head 2 is pressed, the bellows member 6 deforms to the folded-up position and a capacity of the bellows member 6 reduces. By this, inside the bellows member is pressurized; the outflow valve mechanism 5 is opened; and the fluid is discharged from the fluid discharge portion 12. At this time, a capacity of a space, which is partitioned off from the notched portions 428 in the valve member 420 and between the valve member 420 and the leakage prevention member 101 of the fluid-flowing prevention member 104, reduces. By this, the fluid flows into the bellows member 6 from the notched portions 428 in the valve member 420.

Subsequently, when a pressure applied to the pushing portion 11 in the nozzle head 2 is removed, the bellows member 6 deforms to the stretched position by the elastic force of the bellows member 6. By this deformation, a capacity of the bellows member 6 increases. By this, inside the bellows member 6 is depressurized and the inflow valve mechanism 4 is opened. When the inflow valve mechanism 4 is opened, the fluid stored inside the fluid-storing portion 3 flows into the fluid-dispensing pump 1 after having passed through the inflow valve mechanism 4. With the fluid having flowed into the fluid-dispensing pump 1, a fluid amount stored inside the fluid-storing portion 3 decreases. Consequently, the piston 6 ascends according to the volume of the fluid; hereby, the fluid always exists in the vicinity of the inflow valve mechanism 4 inside the fluid-storing portion 3.

When the bellows member 6 continues to deform and returns to its initial position, the leakage prevention member 101 and the guiding portion 427 come into contact closely. By this, the fluid stored in a space, which is partitioned off and between the valve member 420 and the leakage prevention member 101 of the fluid-flowing prevention member 104, does not pass through the leakage prevention member 101, and hence does not flows into the bellows member 6.

Embodiment 2 of the present invention is described in detail below.

Figure 11:
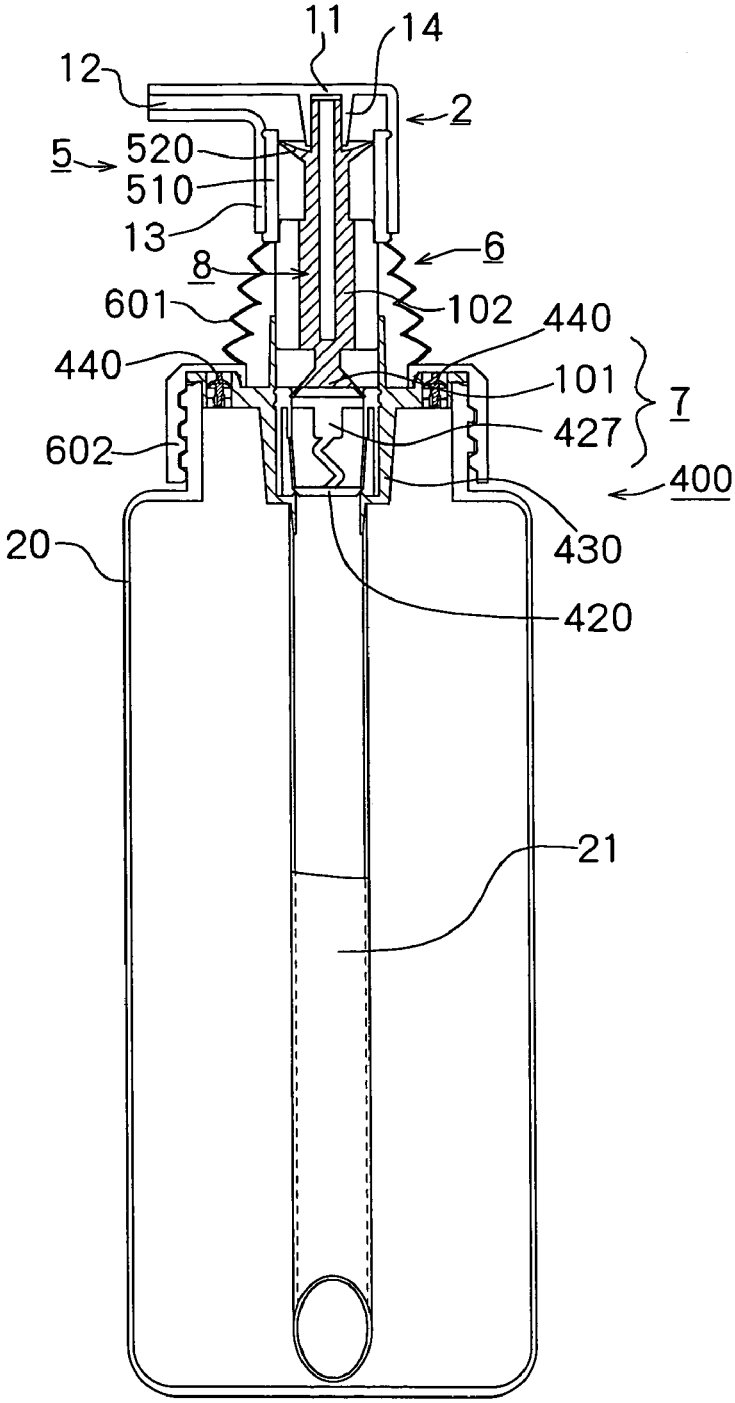
FIG. 11 is a longitudinal cross-section of a fluid-storing container wherein the fluid-dispensing pump 100 according to Embodiment 2 of the present invention is applied.

FIG. 11 is a longitudinal cross-section of a fluid-storing container to which the fluid-dispensing pump 100 according to Embodiment 2 of the present invention applies. Additionally, when the same members as used in Embodiment 1 are used in Embodiment 2, the same symbols are used and detailed descriptions of the members are omitted.

Figure 12:
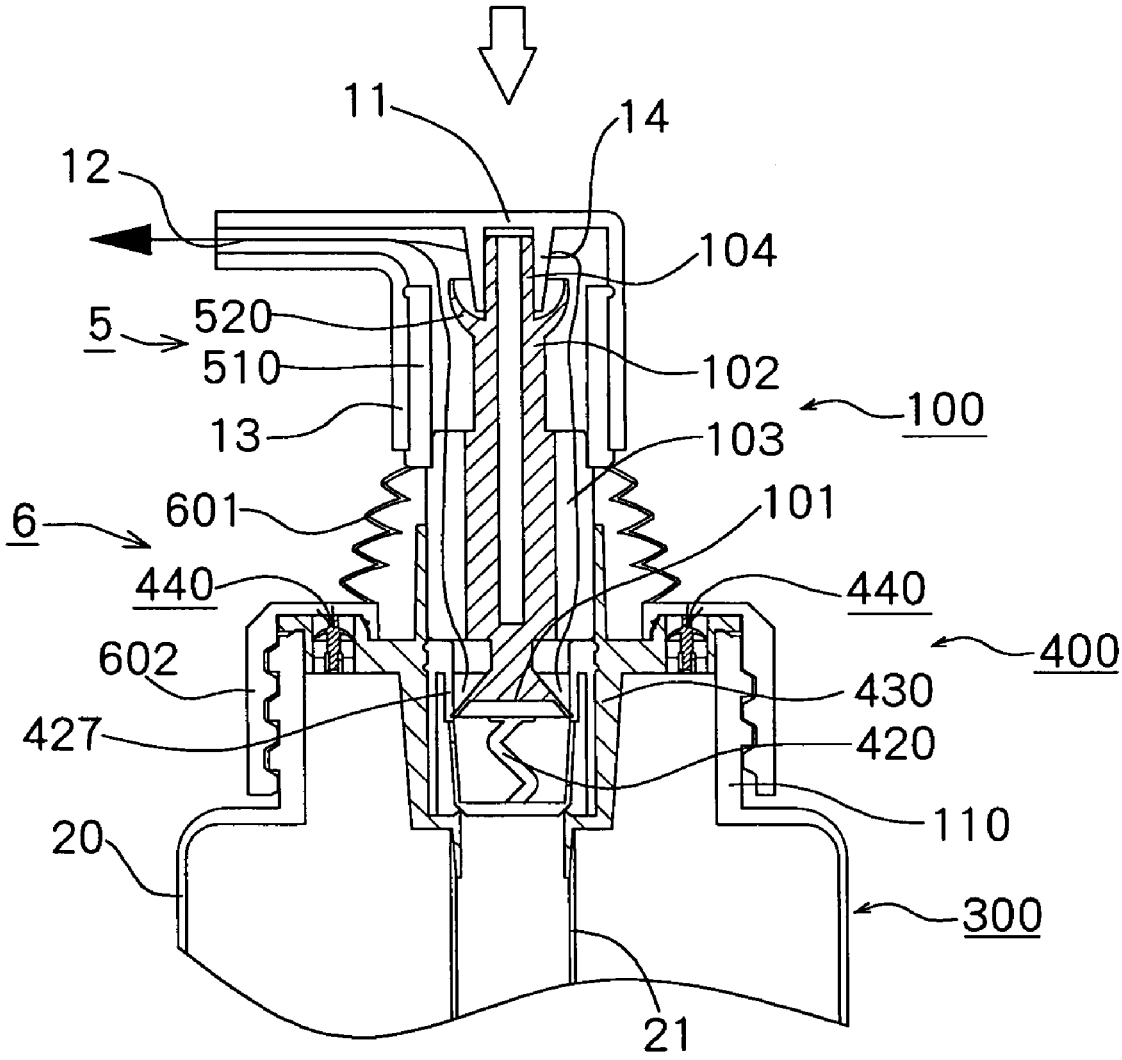
FIG. 12 is an enlarged view showing the substantial part of the fluid-storing container wherein the fluid-dispensing pump 100 according to Embodiment 2 of the present invention is applied.
Figure 13:
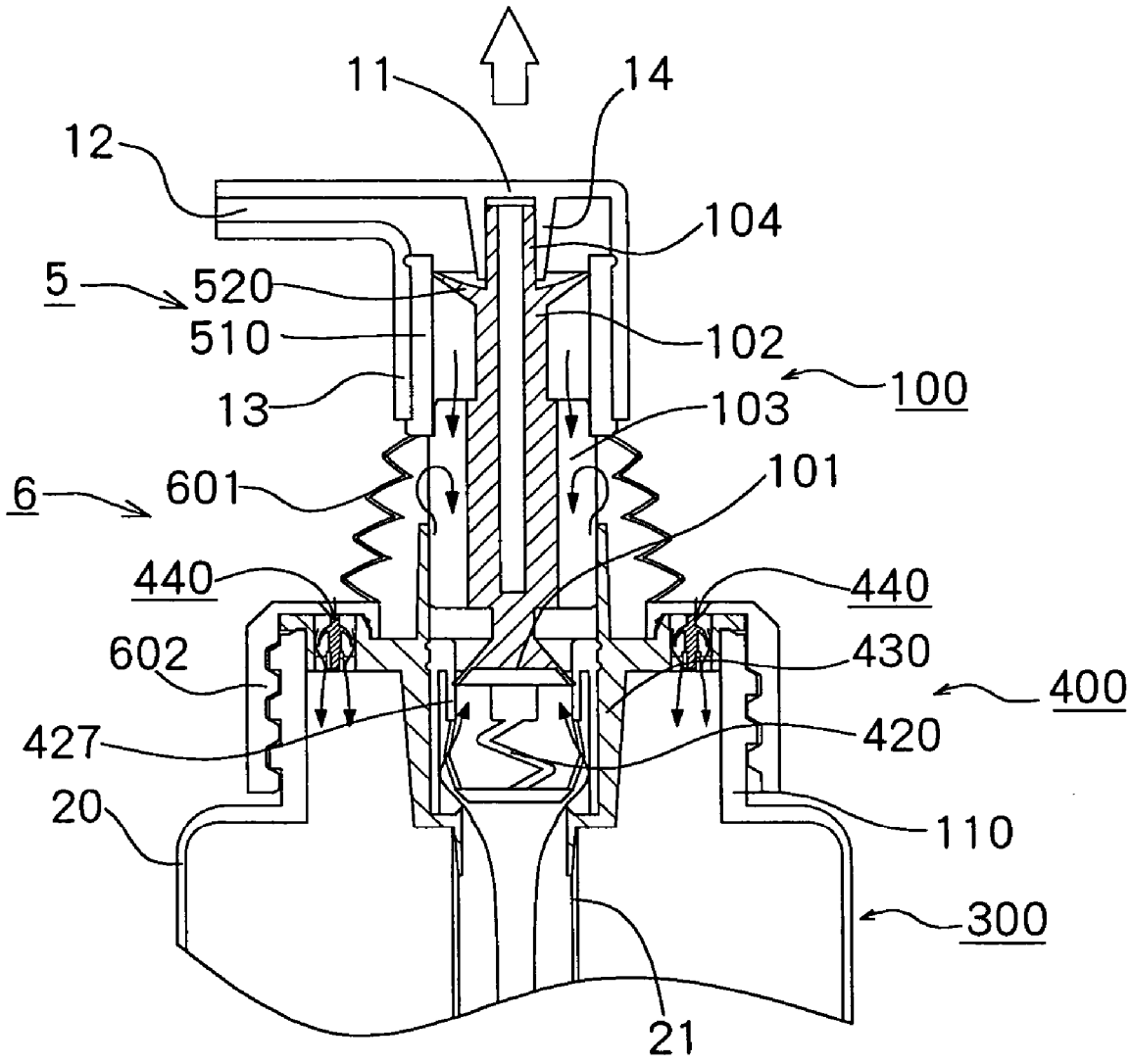
FIG. 13 is an enlarged view showing the substantial part of the fluid-storing container wherein the fluid-dispensing pump 100 according to Embodiment 2 of the present invention is applied.
Figure 14:
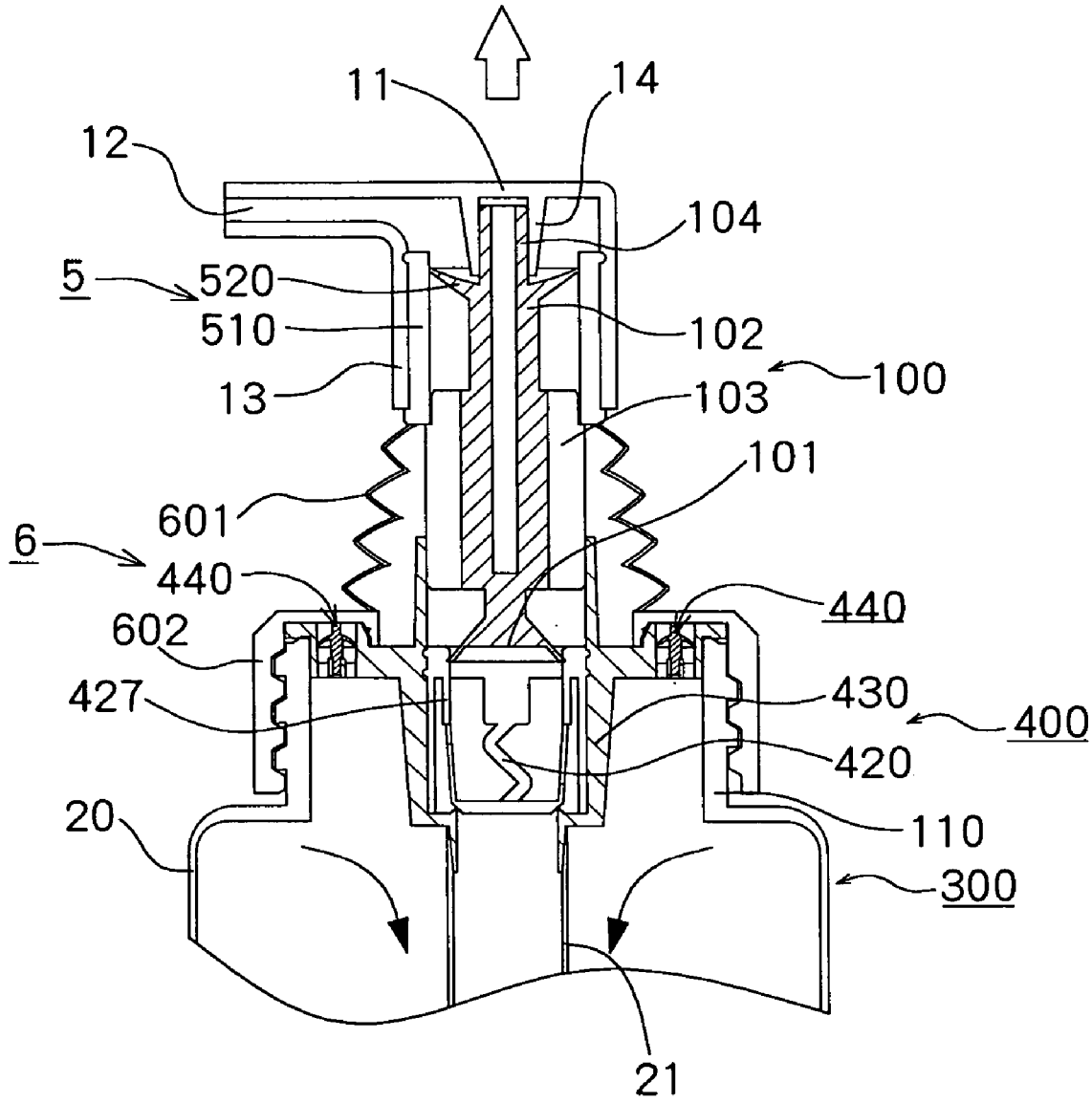
FIG. 14 is an enlarged view showing the substantial part of the fluid-storing container wherein the fluid-dispensing pump 100 according to Embodiment 2 of the present invention is applied.

Of these views, FIG. 11 shows a fluid-dispensing pump 1 being left with no stress applied to it; FIG. 12 shows a bellows member 6 being deforming from a stretched position to a folded-up position with a pushing portion 11 in a nozzle head 2 being pressed; FIG. 13 shows the bellows member 6 being deforming from the folded-up position to the stretched position with a pressure applied to the pushing portion 11 in the nozzle head 2 being removed; FIG. 14 shows the bellows member 6 having returned to its initial stretched-position.

Figure 15:
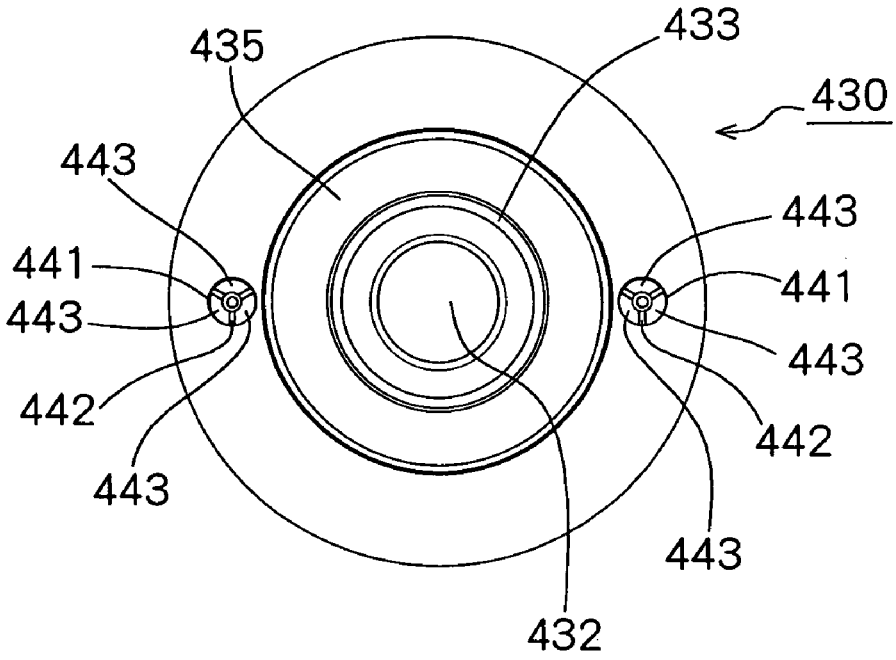
FIGS. 15(*a*) and 15(*b*) are explanatory views showing the valve seat member 430 comprising the inflow valve mechanism 400 according to Embodiment 2 of the present invention.
Figure 15:
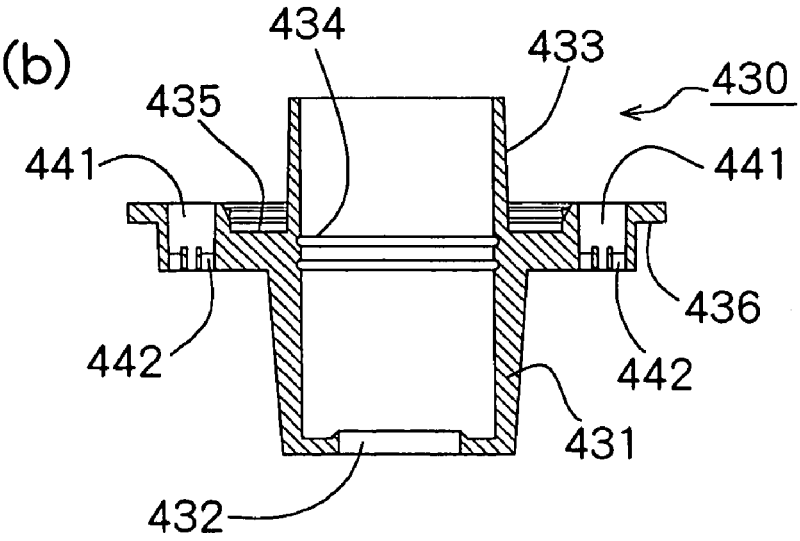

While the fluid-storing container according to Embodiment 1 comprises the fluid-dispensing pump 1 having the inflow valve mechanism 4, the outflow valve mechanism 5, the bellows member 6 and the leakage prevention member 101, the nozzle head 2 having the pushing portion 11 and the fluid discharge portion 12, and the fluid-storing portion 3 having the cylinder 15 and the piston 16 for storing a fluid, the fluid-storing container according to Embodiment 2 comprises a fluid-dispensing pump 100 having an outflow valve mechanism 5, a bellows member 6 and a leakage prevention member 101, a nozzle head 2 having an pushing portion 11 and a fluid discharge portion 12, a fluid-storing portion 300 comprising a fluid-storing tank 20, and an inflow pipe 21 for leading a fluid stored inside the fluid-storing tank 20 to an opening portion 432 (See FIGS. 15(*a*)–(*b*)) in an inflow valve mechanism 4.

In the fluid-storing container according to Embodiment 2, a capacity of the fluid-storing portion 3 (300) cannot be changed by the cylinder 15 and the piston 16, etc. as can be in the fluid-storing container according to Embodiment 1. Consequently, it needs to bring the equal volume of a fluid (e.g., air) to the volume of a fluid having flowed outside from the fluid-storing portion 300 from outside into it.

Therefore, in Embodiment 2, an air inflow mechanism 440 for bringing air from outside into a valve seat member 430 in an inflow valve mechanism 400 is provided in the inflow valve mechanism 400.

Figure 16:
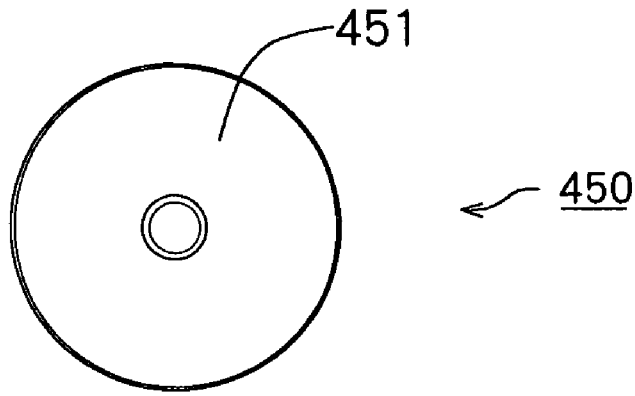
FIGS. 16(*a*), 16(*b*), and 16(*c*) are explanatory views showing the second valve member 450 comprising the air inflow mechanism 440.
Figure 16:
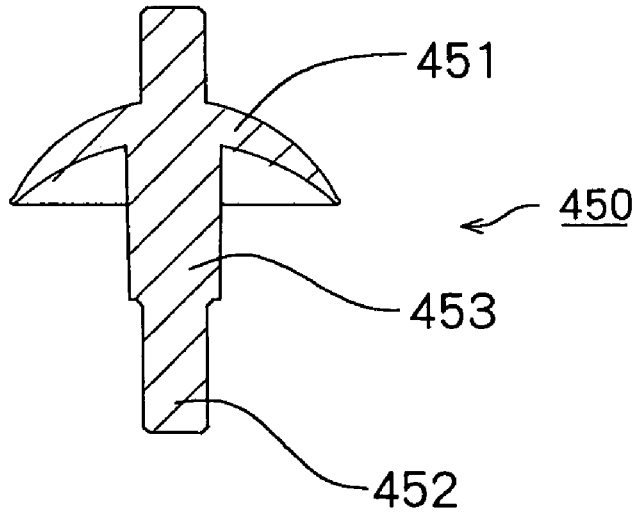
Figure 16:
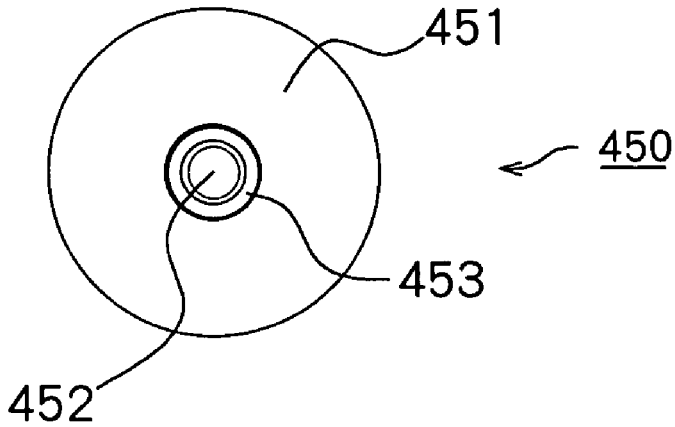

FIGS. 15(*a*) and (*b*) are explanatory views showing the valve seat member 430 comprising the inflow valve mechanism 400 according to Embodiment 2 of the present invention; FIGS. 16(*a*)–(*c*) are explanatory views showing a second valve member 450 comprising the air inflow mechanism 440.

Additionally, of these views, FIGS. 15(*a*)–(*c*) are a plan view, cross sectional view, and bottom view, respectively, showing the valve seat member 430. FIGS. 16(*a*)–(*c*) are a plan view, lateral cross-section, and bottom view, respectively, showing the second valve member 450.

Figure 8:
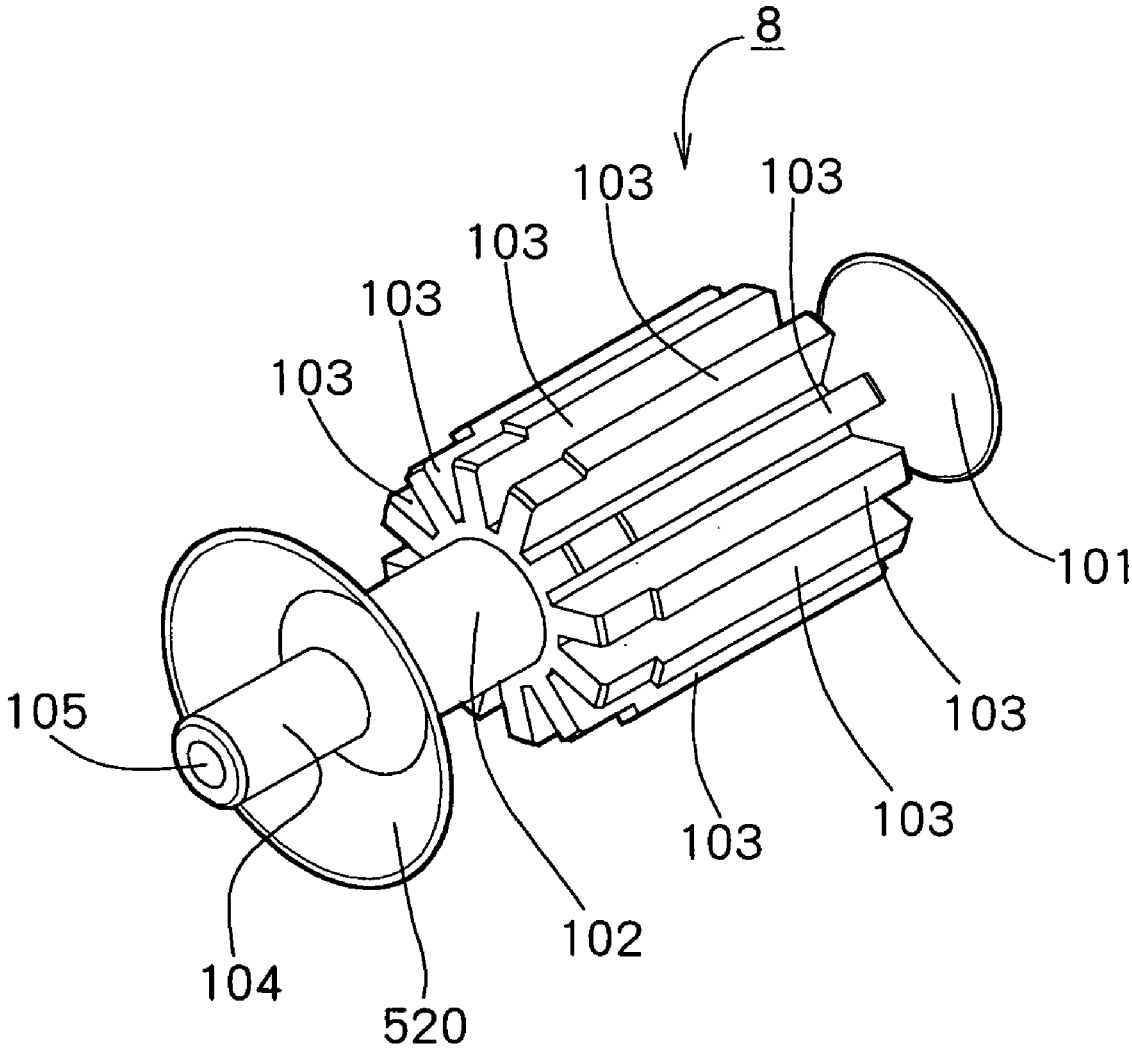
FIG. 8 is a perspective view showing a valve member 520 in the outflow valve mechanism 5 and a fluid-flowing aid 8 having a leakage prevention member 101.
Figure 9:
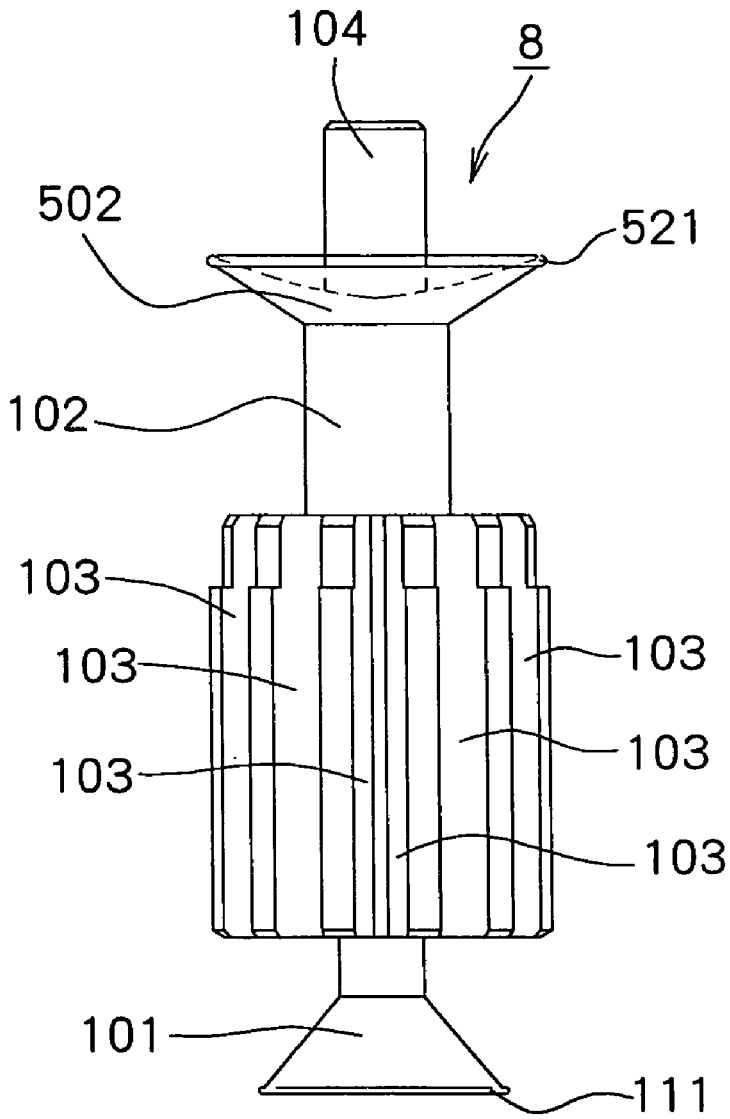
FIG. 9 shows a lateral view of a valve member 520 in the outflow valve mechanism 5 and a fluid-flowing aid 8 having a leakage prevention member 101.
Figure 10:
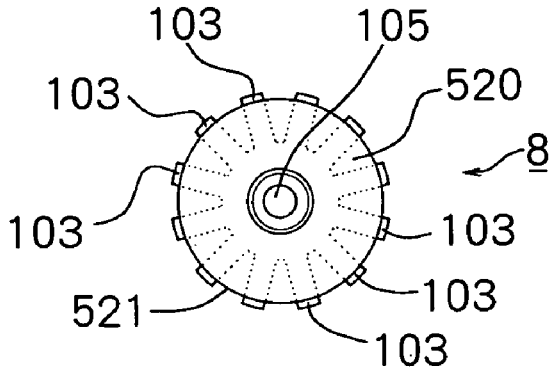
FIGS. 10(*a*), 10(*b*), and 10(*c*) are explanatory views showing a valve member 520 in the outflow valve mechanism 5 and a fluid-flowing aid 8 having a leakage prevention member 101.
Figure 10:
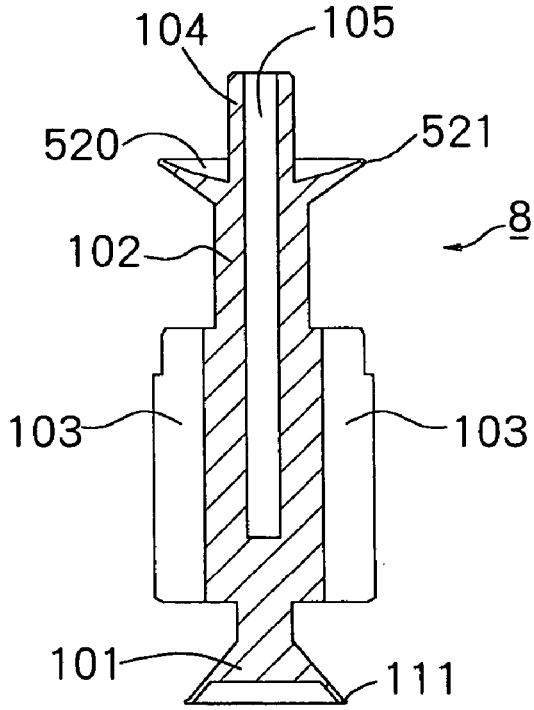
Figure 10:
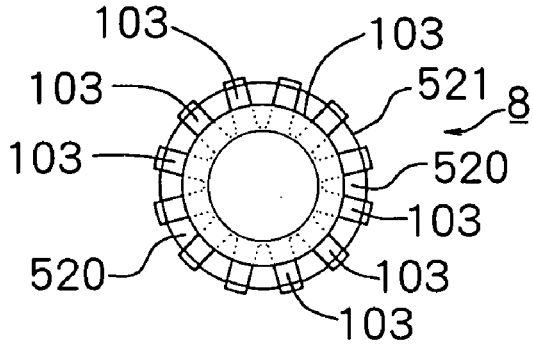

As shown in FIGS. 15(*a*) and (*b*), the valve seat member 430 has a nearly cylindrical valve seat portion 431 at the bottom of which a circular opening portion 432 is formed, and a tubular guiding member 433 for guiding traveling of a coupling member 102 (See FIGS. 8–10.). Additionally, in this valve seat member 430, a first engaging portion 434 for engaging with a valve member 420 (See FIGS. 7(*a*)–(*c*).), a second engaging portion 435 for engaging with the bellows member 6, and a third engaging portion 436 for engaging with the fluid-storing tank 20 are provided. Furthermore, the valve seat member 430, in which two hole portions 441 for air inflow being disposed on an inner side of the third engaging portion 436 as well as on an outer side of the first engaging portion 434 and facing each other are formed, comprises a supporting portion 442 for supporting the second valve member 450 (See FIGS. 16(*a*)–(*c*)) described in detail later inside respective hole portions 441. Additionally, in this supporting portion 442, three grooves 443 for air inflow are formed.

As shown in FIGS. 16(*a*)–(*c*), the second valve member 450 comprises a valve portion 451 having a shape corresponding to an inner wall of the hole portion 441 in the valve seat member 430, a joined portion 452 to be joined with the supporting portion 442 in the valve seat member 430, and a coupling portion 453 for coupling the valve portion 451 and the joined portion 452.

The air inflow mechanism 440 is constituted by joining the supporting portion 442 in the valve seat member 430 and the joined portion 452 in the valve member 442.

In this air inflow mechanism 440, when inside the fluid-storing tank 20 is depressurized when a fluid stored inside the fluid-storing portion 300 flows into the bellows member 6 after having passed through the inflow valve mechanism 400, the valve portion 451 (See FIGS. 16(*a*)–(*c*)) travels to an open position in which it separates from the inner walls of the hole portions 441. By this, air outside the fluid-storing container flows into the fluid-storing tank 20. When inside the fluid-storing tank is not depressurized, the valve portion 451 travels to a position in which it contacts the inner walls of the hole portions 441. By this, air inflow from outside the fluid-storing container into the fluid-storing tank 20 is prevented.

In the fluid-storing container according to Embodiment 2 having the above-mentioned configuration, when the pushing portion 11 in the nozzle head 2 is pressed, the bellows member 6 deforms to a folded-up position and a capacity of the bellows member 6 reduces. By this, inside the bellows member 6 is pressurized; the outflow valve mechanism is opened; and a fluid is discharged from the discharge portion 12 of the nozzle head 2. At this time, a capacity of a space, which is partitioned off from the notched portions 428 in the valve member 420 and between the valve member 420 and the leakage prevention member 101 of the fluid-flowing prevention member 104, reduces. Consequently, the fluid flows into the bellows member 6 from notched portions 428 in the valve member 420.

Subsequently, when a pressure applied to the pushing portion 11 of the nozzle head 2 is removed, the bellows member 6 deforms to the stretched position by the elastic force of the bellows member 6. By this deformation, a capacity of the bellows member 6 increases. By this, inside the bellows member 6 is depressurized, and the inflow valve mechanism 400 is opened. When the inflow valve mechanism 400 is opened, the fluid stored inside the fluid-storing portion 300 flows into the fluid-dispensing pump 1 after having passed through the inflow valve mechanism 400. With the fluid having flowed into the fluid-dispensing pump 1, a fluid amount stored inside the fluid-storing portion 3 decreases, and inside the fluid-storing portion 3 is depressurized. Consequently, the air inflow mechanism 440 is opened and air is taken into the fluid-storing portion 300 from outside. By this, a pressure inside the fluid-storing portion 300 and a pressure outside the fluid-storing portion 300 are maintained constantly; and hence, unreasonable pressure is not given to the fluid-storing tank 20 and to an inflow pipe 21 because of a pressure change occurring inside the fluid-storing portion 300.

When the bellows member 6 continues to deform and returns to its initial position, the leakage prevention member 101 and the guiding portion 427 come into contact closely. By this, the fluid stored in a space, which is partitioned off and between the valve seat member 420 and the leakage prevention member 101 of the fluid-flowing prevention member 104, does not pass through the leakage prevention member 101, and hence does not flows into the bellows member 6.

The present invention includes the above mentioned embodiments and other various embodiments including the following:

1) A fluid-dispensing pump for discharging a fluid stored inside a fluid-storing portion from a nozzle head disposed on the upper side of the fluid-storing portion by pressing the nozzle head; the fluid-dispensing pump is characterized by comprising a resinous bellows member having an inflow opening and an outflow opening and deforming from a stretched position in which it holds a relatively large amount of fluid therein to a folded-up position in which it holds a relatively small amount of fluid therein when compressed by the nozzle head, an inflow valve mechanism coupled with the inflow opening of the bellows member, an outflow valve mechanism coupled with the outflow opening of the bellows member, and a leakage prevention member being disposed inside the bellows member and between the inflow valve mechanism and the outflow valve mechanism, which enables the fluid to pass through only when the bellows member deforms from a folded-up position to a stretched position.

2) In the fluid-dispensing pump of Item 1, the bellows member restores to the stretched position from the folded-up position by its own elastic force.

3) The fluid-dispensing pump of Item 1 further comprises a coupling member for coupling the outflow valve mechanism and the leakage prevention member so as to enable them to travel relative to the inflow valve mechanism as the bellows member stretches and folds up.

4) The fluid-dispensing pump of Item 3 further comprises a guiding member between the inflow valve mechanism and the outflow valve mechanism for guiding traveling of the coupling member.

5) In the fluid-dispensing pump of Item 4, the inflow valve mechanism and the guiding member are joined together integrally.

6) In the fluid-dispensing pump of Item 4 or 5, the coupling member comprises multiple ribs corresponding to a shape of the guiding member.

7) In the fluid-dispensing pump of any one of Items 1 to 6, the inflow valve mechanism comprises a valve seat member in which an opening portion for fluid inflow is formed and a valve member comprising an annular supporting portion, a valve portion having a shape corresponding to the opening portion of the valve seat portion, and multiple coupling portions for coupling the supporting portion and the valve potion.

8) In the fluid-dispensing pump of Item 7, the valve seat member in the inflow valve mechanism has a nearly cylindrical shape at the bottom of which a circular opening portion is formed; the valve member in the inflow valve mechanism comprises an annular supporting portion disposed inside the valve seat member in the inflow valve mechanism, a valve portion having a shape corresponding to the circular opening portion, and multiple flexible coupling portions for coupling the supporting portion and the valve portion.

9) In the fluid-dispensing pump of any one of Items 1 to 8, the outflow valve mechanism comprises a tubular valve seat member and a flexible valve member having a shape corresponding to an inner wall of the valve seat member.

In the above, because the invention according to Item 1 comprises the bellows member having the inflow opening and the outflow opening and deforming from a stretched position in which it holds a relatively large amount of fluid therein to a folded-up position in which it holds a relatively small amount of fluid therein when compressed by the nozzle head, the inflow valve mechanism coupled with the inflow opening of the bellows member, the outflow valve mechanism coupled with the outflow opening of the bellows member, and the leakage prevention member being disposed inside the bellows member and between the inflow valve mechanism and the outflow valve mechanism, which enables the fluid to pass through only when the bellows member deforms from a folded-up position to a stretched position, it becomes possible to prevent the fluid from leaking out even though a configuration is simple.

Because in the invention according to Item 2, the bellows member restores to the stretched position from the folded-up position by its own elastic force, it becomes possible to facilitate handling operation for discharging a fluid stored inside the fluid-dispensing pump.

Because the invention according to Item 3 comprises a coupling member for coupling the outflow valve mechanism and the leakage prevention member so as to enable them to travel relative to the inflow valve mechanism as the bellows member stretches and folds up, it becomes possible to give a simpler configuration to the fluid-dispensing pump.

Because the invention according to Item 4 comprises a guiding member between the inflow valve mechanism and the outflow valve mechanism for guiding traveling of the coupling member, traveling of the leakage prevention is stabilized even when the bellows member is used, thereby enabling further to prevent the fluid from leaking out.

Because in the invention according to Item 5, the inflow valve mechanism and the guiding member are joined together integrally, it becomes possible to give a simpler configuration to the fluid-dispensing pump.

Because in the invention according to Item 6, the coupling member comprises multiple ribs corresponding to a shape of the guiding member, it becomes possible to make a fluid to flow smoothly between the leakage prevention member and the outflow valve mechanism as well as to further stabilize traveling of the leakage prevention member.

Because in the inventions according to Item 7 and Item 8, the inflow valve mechanism comprises a valve seat member in which an opening portion for fluid inflow is formed and a valve member having an annular supporting portion, a valve portion having a shape corresponding to the opening portion of the valve seat portion and multiple coupling portions for coupling the supporting portion and the valve potion, backward flow of the fluid can be prevented reliably even though a configuration is simple. Additionally, it becomes possible to change a flow rate of the fluid passing through arbitrarily according to a pressure difference between the fluid inflow side and the fluid outflow side of the inflow valve mechanism.

Because in the invention according to Item 9, the outflow valve mechanism comprises the tubular valve seat member and the flexible valve member having a shape corresponding to an inner wall of the valve seat member, backward flow of the fluid can be prevented reliably even though a configuration is simple. Additionally, it becomes possible to change a flow rate of the fluid passing through arbitrarily according to a pressure difference between the fluid inflow side and the fluid outflow side of the outflow valve mechanism.

Further, although the foregoing embodiments are preferable, the following modifications can be applied to any of the foregoing embodiments:

In an embodiment, instead of the bellows member 6, a cylindrical member can be used which liquid-tightly slides against another cylindrical member attached to the neck portion of the fluid-storing portion. Such a cylindrical member may be provided with an urging member such as a spring.

In an embodiment, the bellows member 6 may not be self-restorable, and any urging member such as a spring disposed inside the bellows member between the nozzle head and the neck portion can be used.

In an embodiment, the fluid-flowing aid 8 may not have ribs, and instead of ribs, a hollow cylindrical member can be attached to the fluid-flowing aid or a hollow center of the fluid-flowing aid 8 can be used as a fluid passage. However, ribs are preferable because an area of ribs which is in contact with an inner surface of the guiding portion 413 can be reduced, thereby rendering movement of the ribs (the outflow valve mechanisms and the leakage prevention mechanism) smooth. The number of ribs may be an integer of 3–20.

In an embodiment, the valve member 520 and the leakage prevention member 101 may not be connected by the coupling member 102. The valve member 520 can be provided in the nozzle head separately from the valve 101 and the coupling member 102. Further, the valve member 520 can be disposed in the vicinity of the fluid discharge portion 12. Any suitable valve can be used which opens only when the nozzle head is pressed downward.

In an embodiment, the leakage prevention member 101 may not have a truncated cone shape or an umbrella shape but may have a disk shape or cylindrical shape or be constituted by stacked multiple disks. Further, the supporting portion 421 may not serve as the guiding portion 427 for the leakage prevention member 101, and the guiding portion 427 may be disposed separately from the inflow valve mechanism 4 between the outflow valve mechanism and the inflow valve mechanism. In an embodiment, the guiding portion comprised of a full surface portion and a notched surface portion may not be used, and instead an annular seat member can be used where the leakage prevention member is in contact with the annular seat member and close it when the nozzle head is not pressed. The movement of the leakage prevention member can be controlled by the guiding portion 413 for the fluid-flowing aid 8 without the notched surface portion 428'. The supporting portion 421 is preferably used as a valve seat for the leakage prevention member 101, eliminating any additional member.

The inflow valve mechanism can be of any type such as those disclosed in U.S. Pat. No. 6,688,495 to Masatoshi Masuda (the inventor of the present application), the disclosure of which is herein incorporated by reference in its entirety.

Further, the disclosure of United States Patent Publication No. 2004/0055457 to Masatoshi Masuda (the inventor of the present application) is herein incorporated by reference in its entirety. Any elements disclosed in the publication which are applicable to any embodiments of the present invention can be used.

The tubular valve seat member 510, the bellows member 601, and the joined portion 602 can be integrally formed. The joined portion 602 can be eliminated when the inflow valve mechanism can be fitted in the neck portion of the fluid-storing portion. The tubular valve seat member 510 can be eliminated when an inner surface of the nozzle head can be used to guide the outflow valve mechanism. Further, the guiding portion 413, the valve seat member 410, and the flange portion 415, 416 can be integrally formed.

The outflow valve mechanism and the leakage prevention mechanism can be integrally formed via the coupling member. Alternatively, the valve member of the outflow valve mechanism or the leakage prevention member can be separately formed and press-fitted to the coupling member. In an embodiment, the pump can be constituted by only four pieces: 1) the valve member of the outflow valve mechanism, the coupling member, the ribs, and the leakage prevention member, 2) the tubular valve seat member for the outflow valve mechanism, the bellows member, and the joined portion, 3) the guiding member for the ribs, the valve seat member of the inflow valve mechanism, and the flange, and 4) the valve member of the inflow valve mechanism (the annular supporting portion serves as the guiding portion for the leakage prevention member).

All of the elements can be made of a resin such as polyethylene and polypropylene, rubber composite such as silicon rubber, or a mixture of the foregoing. However, hardness of each element can be adjusted even though multiple elements are integrally formed as a one piece by adjusting curing methods, dimensions or shapes.

The present application claims priority to Japanese Patent Application No. 2004-028770, filed Feb. 5, 2004, the disclosure of which is incorporated herein by reference in its entirety.

It will be understood by those of skill in the art that numerous and various modifications can be made without departing from the spirit of the present invention. Therefore, it should be clearly understood that the forms of the present invention are illustrative only and are not intended to limit the scope of the present invention.

What is claimed is:

1. A fluid-dispensing pump for discharging therethrough a fluid stored inside a fluid-storing portion from a nozzle head, said fluid-dispensing pump being configured to be disposed between the fluid-storing portion and the nozzle head and comprising:

a compressible hollow structure having an inflow opening and an outflow opening, through which the fluid passes, said compressible hollow structure being compressible between an extended position and a compressed position;

an inflow valve mechanism connected to the inflow opening of the compressible hollow structure, said inflow valve mechanism being a one-way valve which opens when the compressible hollow structure is extended from the compressed position to the extended position;

an outflow valve mechanism connected to the outflow opening of the compressible hollow structure, said outflow valve mechanism being a one-way valve which opens when the compressible hollow structure is compressed from the extended position to the compressed position; and a leakage prevention valve mechanism being disposed within the compressible hollow structure and between the inflow valve mechanism and the outflow valve mechanism, said leakage prevention valve mechanism comprising a valve which is movable with the compressible hollow structure, which is closed when the compressible hollow structure is at the extended position, and which is open when the compressible hollow structure is between the extended position and the compressed position.

2. The fluid-dispensing pump according to claim 1, wherein the compressible hollow structure is constituted by a bellows member.

3. The fluid-dispensing pump according to claim 2, wherein the bellows member is capable of restoring to the extended position from compressed position by its own elastic force.

4. The fluid-dispensing pump according to claim 1, wherein a valve member of the outflow valve mechanism and a valve member of the leakage prevention valve mechanism are connected by a coupling member to move together relative to the inflow valve mechanism as the compressible hollow structure is compressed or extended.

5. The fluid-dispensing pump according to claim 4, further comprising a guiding member disposed between the inflow valve mechanism and the outflow valve mechanism for guiding movement of the coupling member.

6. The fluid-dispensing pump according to claim 5, wherein the guiding member is connected integrally to the inflow valve mechanism.

7. The fluid-dispensing pump according to claim 4, wherein the coupling member comprises multiple ribs each extending outward from an axis of the coupling member, wherein the fluid passes through spaces between the multiple ribs.

8. The fluid-dispensing pump according to claim 5, wherein the guiding member is cylindrical.

9. The fluid-dispensing pump according to claim 8, wherein the coupling member comprises multiple ribs each extending outward from an axis of the coupling member, wherein the fluid passes through spaces between the multiple ribs, and outer edges of the ribs slide upon an inner surface of the guiding member.

10. The fluid-dispensing pump according to claim 1, wherein the leakage prevention valve mechanism further comprises a valve guiding member connected to the inflow valve mechanism, wherein a peripheral edge of the valve of the leakage prevention valve mechanism slides upon an inner surface of the valve guiding member.

11. The fluid-dispensing pump according to claim 10, wherein the inner surface of the valve guiding member is comprised of a full surface portion and a notched surface portion, wherein the valve of the leakage prevention mechanism is closed when the peripheral edge of the valve of the leakage prevention valve mechanism is on the full surface portion, and the valve of the leakage prevention mechanism is open when the peripheral edge of the valve of the leakage prevention valve mechanism is on the noticed surface portion.

12. The fluid-dispensing pump according to claim 11, wherein the inflow valve mechanism comprises a valve seat member in which an opening portion for fluid inflow is formed, and a valve member comprising an annular supporting portion, a valve portion having a shape corresponding to the opening portion of the valve seat member, and multiple flexible coupling portions for coupling the supporting portion and the valve portion, wherein the annular supporting portion serves as the valve guiding member for the leakage prevention valve mechanism.

13. The fluid-dispensing pump according to claim 12, wherein the valve seat member of the inflow valve mechanism has a nearly or substantially cylindrical shape at the bottom of which a circular opening portion is formed, and the valve member is disposed inside the valve seat member.

14. The fluid-dispensing pump according to claim 6, wherein the inflow valve mechanism comprises a valve seat member in which an opening portion for fluid inflow is formed, and a valve member comprising an annular supporting portion, a valve portion having a shape corresponding to the opening portion of the valve seat member, and multiple flexible coupling portions for coupling the supporting portion and the valve portion, wherein the guiding member for the coupling member is integrated with the valve seat member.

15. The fluid-dispensing pump according to claim 14, wherein the valve seat member has a flange configured to be attached to a neck portion of the fluid-storing portion.

16. The fluid-dispensing pump according to claim 15, wherein the flange is provided with an air inflow mechanism for introducing air into the fluid-storing portion as an inner pressure of the fluid-storing portion decreases.

17. The fluid-dispensing pump according to claim 1, wherein the outflow valve mechanism comprises a tubular valve seat member and a flexible valve member having a shape corresponding to an inner surface of the valve seat member.

18. A container for storing and discharging a fluid, comprising:

a fluid-storing portion for storing a fluid therein;

a nozzle head for discharging the fluid therethrough; and the fluid-dispensing pump set forth in claim 1 provided between the fluid-storing portion and the nozzle head.

19. The container according to claim 18, wherein the fluid-storing portion is comprised of a neck portion to which the fluid-dispensing pump is connected, a side wall, and a piston provided at a bottom opposite to the neck portion, said piston being movable toward the neck portion as an inner pressure of the fluid-storing portion decreases.

20. The container according to claim 18, wherein the fluid-storing portion is comprised of a neck portion to which the fluid-dispensing pump is connected, a side wall, and a bottom, wherein the inflow valve mechanism has a flange attached to the neck portion, said flange provided with an air inflow mechanism for introducing air into the fluid-storing portion as an inner pressure of the fluid-storing portion decreases.

* * * * *